United States Patent [19]

Isakson et al.

[11] Patent Number: 4,640,838

[45] Date of Patent: Feb. 3, 1987

[54] SELF-VENTING VAPOR-TIGHT MICROWAVE OVEN PACKAGE

[75] Inventors: Gary A. Isakson, Woodbury, Minn.; Curtis L. Larson, Hudson, Wis.

[73] Assignee: Minnesota Mining and Manufacturing Company, Saint Paul, Minn.

[21] Appl. No.: 647,882

[22] Filed: Sep. 6, 1984

[51] Int. Cl.[4] ..... B65D 51/16; B65D 81/34; H05D 9/00

[52] U.S. Cl. ..... 426/107; 426/113; 426/118; 229/DIG. 14; 219/10.55 E; 220/367

[58] Field of Search ..... 426/107, 118, 234, 243, 426/241, 113; 219/10.55 E, 10.55 M, 10.55 R, 10.55 F; 229/DIG. 14, 3.5 MF; 220/363, 367; 383/100, 103; 99/451

[56] References Cited

U.S. PATENT DOCUMENTS

| | | | |
|---|---|---|---|
| 2,633,284 | 3/1953 | Moffett et al. | 426/118 |
| 2,927,722 | 3/1960 | Metzger | 383/103 |
| 3,052,554 | 9/1962 | Colman | 426/111 |
| 3,054,680 | 9/1962 | Mennen | 229/3.5 MF |
| 3,312,368 | 4/1967 | Reynolds et al. | 220/367 |
| 3,410,697 | 11/1968 | Stephenson | 426/114 |
| 3,432,087 | 3/1969 | Costello | 426/118 |
| 3,672,916 | 6/1972 | Virnig | 426/114 |
| 3,716,180 | 2/1973 | Bemiss et al. | 426/118 |
| 3,941,967 | 3/1976 | Sumi et al. | 426/107 |
| 4,013,798 | 3/1977 | Goltsos | 426/107 |
| 4,141,487 | 2/1979 | Faust et al. | 229/43 |
| 4,190,757 | 2/1980 | Turpin et al. | 426/107 |
| 4,210,674 | 7/1980 | Mitchell | 426/118 |
| 4,261,504 | 4/1981 | Cowan | 426/118 |
| 4,292,332 | 9/1981 | McHam | 426/111 |
| 4,358,466 | 11/1982 | Stevenson | 426/118 |
| 4,362,917 | 12/1982 | Freedman et al. | 426/243 |
| 4,390,554 | 6/1983 | Levinson | 426/234 |
| 4,398,077 | 8/1983 | Freedman et al. | 219/10.55 F |
| 4,404,241 | 9/1983 | Mueller et al. | 428/35 |
| 4,419,373 | 12/1983 | Oppermann | 426/234 |
| 4,425,368 | 1/1984 | Watkins | 426/107 |
| 4,434,197 | 2/1984 | Petriello et al. | 427/407 |
| 4,450,334 | 5/1984 | Bowen et al. | 426/243 |
| 4,454,403 | 6/1984 | Teich et al. | 219/10.55 M |
| 4,486,640 | 12/1984 | Bowen et al. | 426/243 |
| 4,496,815 | 1/1985 | Jorgensen | 219/10.55 F |

*Primary Examiner*—Steven Weinstein
*Attorney, Agent, or Firm*—Donald M. Sell; James A. Smith; William L. Huebsch

[57] ABSTRACT

A vapor-tight package has a deposit comprising nonmetallic, microwave-absorbing particles such as graphite dispersed in nonmetallic binder. When heated in a microwave oven, heat built up in the particles may soften and weaken the underlying packaging material, thus venting the package. When the deposit itself is impervious to vapors, it can be positioned over an opening in the package, and the heat only needs to soften and weaken the deposit to vent the package.

17 Claims, 6 Drawing Figures

SELF-VENTING VAPOR-TIGHT MICROWAVE OVEN PACKAGE

FIELD OF THE INVENTION

The invention concerns a vapor-tight package including means automatically venting the package when it is heated in a microwave oven.

BACKGROUND ART

Instructions for heating vapor-tight packages in a microwave oven usually call for first piercing each package with a sharp utensil. See, for example, FIG. 22 of U.S. Pat. No. 4,425,368 (Watkins). Vapor-tight frozen food packages which comprise polymeric or plastic film can be hard to pierce, and one may think that the film has been pierced when it has only been indented. If the film is not pierced, vapor pressures built up during heating may cause the package to explode. Instead of exploding, the package may rip at a seam through which the contents may spill out into the oven.

A number of self-venting, vapor-tight microwave oven packages have been proposed. Each of the packages shown in U.S. Pat. No. 4,013,798 (Goltsos) consists of a compartmented plastic tray across which is sealed a plastic film. A side wall of one or more of the compartments has a notch at which the plastic film is less well sealed so that a buildup of vapor pressure in a compartment breaks the seal at the notch to vent the compartment.

U.S. Pat. No. 4,292,332 (McHam) concerns a vapor-tight package for popping popcorn in a microwave oven. Its top wall is provided with lines of weakness that will begin to rupture at a vapor pressure less than that which would cause the bag to explode.

U.S. Pat. No. 4,141,487 (Faust et al.) concerns a vapor-tight package comprising a plastic film which is formed with a slit along a crease line. The edges of the slit are sealed together by an adhesive sealant material that melts below the cooking temperature to open the slit and thereby release vapors.

U.S. Pat. No. 4,404,241 (Mueller et al.) concerns a vapor-tight package comprising a heat-resistant sheet formed with apertures, and bonded to that sheet is a continuous heat-softening material which extends across the apertures. Rising temperatures and pressures within the package cause the heat-softening material to flow to create vents through the apertures.

U.S. Pat. No. 4,390,554 (Levinson) concerns a vapor-tight, multi-layer microwave oven package including a liquid-barrier plastic film 4 such as nylon or polyester which is "designed to vent at a preselected temperature by blow out plugs 13 or can be constructed of a low temperature plastic (as polyethylene) formulated to melt at a predetermined temperature". See col. 4, lines 30–40, and FIG. 1.

U.S. Pat. No. 4,210,674 (Mitchell) illustrates a tray which is hermetically sealed by a plastic film to which a narrow strip of aluminum foil is adhesively secured. When the aluminum foil has certain dimensions, it converts microwave energy to heat sufficient to melt the plastic film, thus venting the package. When we constructed such a package, the venting did occur, but there was visible and audible arcing which would probably be objectionable to prospective users. Also, it was difficult to adhere such a narrow strip of aluminum foil to a plastic film. Furthermore, many food processors routinely monitor their products to locate any hazardous metal objects, and such an aluminum strip might interfere.

The Mitchell patent suggests at column 3, lines 18–30 that substitutes for the aluminum foil include "silver micropaint", "a copper-filled coating" and "dispersions of metal powder", and that such substituents may be applied by "a printing wheel or a spray applicator".

OTHER PRIOR ART

U.S. Pat. No. 4,434,197 concerns a reusable flexible sheet containing semi-conductive or energy-absorbing material such as colloidal graphite, ferric oxide and carbon (col. 5, lines 26–32). When the sheet is wrapped around food to be cooked in a microwave oven the semi-conductive material becomes hot enough to permit browning or crisping of the food. The semi-conductive material is encapsulated between layers of polytetrafluoroethylene which is so heat resistant that the sheet can be reused.

BRIEF DISCLOSURE OF THE INVENTION

The invention concerns a vapor-tight package including means for automatically venting through the package upon heating in a microwave oven, as do the vapor-tight packages of the patents discussed above under "Background Art". The novel package differs from the above-discussed prior packages in that its venting means is a deposit which is adhered to the package and comprises nonmetallic, microwave-absorbing particles dispersed in a nonmetallic binder, preferably a polymeric binder, which deposit has a thickness within the range from 10 to 300 micrometers, said particles comprising at least 10% by weight of said deposit.

Preferred nonmetallic, microwave-absorbing particles are graphite and carbon black particles. Somewhat less, but still highly absorptive of microwave energy, are iron oxide and ferrite particles. All such nonmetallic particles which are highly-absorptive of microwave energy are hereinafter called "microwave-absorbing particles".

When the package comprises heat-sensitive material such as thermoplastic film and the deposit is adhered to the film, heating of the particles by microwaves can soften and weaken that portion of the film to which the deposit is adhered, thus venting the package through that portion. When an unfilled adhesive layer adheres the deposit to a packaging material which is to be weakened by heat from the particles, that adhesive layer should be thin to afford good heat transfer, preferably from 10 to 20 micrometers.

When the deposit itself is impervious to vapors, but softens and weakens when heated by the particles, it can be positioned over a weakness in the package such as an opening, a slit, or a score. When so used, it may be desirable to cover the deposit with a vapor-impervious thermoplastic film. Upon doing so, heat from the particles may either soften and weaken the covering thermoplastic film, or venting may occur laterally through the deposit or through an unfilled adhesive layer by which the deposit is adhered over a weakness of the package.

For economy, the nonmetallic binder of the deposit should be the minimum proportion that will firmly anchor the microwave-absorbing particles but, when the binder also serves to adhere the deposit to the package, that proportion should be high enough to assure good adhesion. The particles should be firmly anchored when the binder comprises at least 30% by weight of the deposit, but when the binder also serves as an adhesive, it preferably comprises more than 50 weight percent of the deposit. When a separate adhesive coating is used, the binder preferably comprises from 30 to 80 weight percent of the deposit. Particles which are substantially less absorptive of microwave energy than is graphite preferably comprise about 60% by weight of the deposit.

The dispersion of microwave-absorbing particles in nonmetallic binder can be printed or otherwise directly deposited onto the packaging. When printed, the deposit can form an alpha-numeric message or a distinctive pattern that informs the user of the self-venting nature of the package. Whether printed or cut from a preformed sheet, the deposit may be shaped to concentrate the microwave energy. Preliminary experiments suggest that notches in the edges of the deposit have such effect, but this has not been confirmed. Preferably the deposit has a distinctive shape to remind the user by its very appearance that the package is self-venting and to position the package in the oven so that nothing spills when the vent forms. For such reasons, the deposit preferably is highly conspicuous. The deposit may have the shape of a logo or trademark to identify the company marketing the package.

For convenience and economy, the deposit may be a piece of a layer of tape which itself is believed to be novel. Such a tape comprises a carrier web, adhered to the carrier web a layer of particles selected from a graphite and carbon black dispersed in nonmetallic binder, said particles comprising at least 10% by weight of the layer, the layer having a thickness within the range from 10 to 300 micrometers, and means for adhering a piece of said layer to a package to provide self-venting of the package in a microwave oven.

The particle-containing layer may be coextensive with the carrier web and may be die-cut in the form of individual shapes such as a star or a diamond, at least one piece to be adhered to each package to provide a venting deposit. While the nonmetallic binder may serve to adhere the pieces to a package to be vented as is pointed out above, the tape may include an unfilled adhesive layer.

The carrier web of the tape may have a low-adhesion surface from which pieces of the particle-containing layer can be cleanly peeled, thus permitting the carrier web to be reused. On the other hand, the carrier web can remain firmly adhered to the deposit. When the carrier web is vapor-impervious and is selected to soften and weaken when the microwave-absorbing particles of the deposit are heated by microwave energy, the package can be made with a heat-resistant plastic film such as cellophane which the deposit would not soften by positioning the deposit over a weakness in the package such as an opening, slit, or score.

To insure reliable venting before a package explodes due to vapor pressure buildup, the deposit preferably has a thickness of at least 20 micrometers and a width of at least 5 mm in all directions. At lesser dimensions, heat might be conducted or radiated away from the microwave-absorbing particles before it could produce the desired venting. Thicknesses greater than 100 micrometers may be economically wasteful and may cause arcing in a microwave oven.

Because of lateral heat conduction, the venting usually occurs at the center of the deposit. A deposit in the shape of a "C" or "U" tends to produce venting along a correspondingly shaped line, and this may open a flap to create quite a large vent. A vent produced by a small circular deposit may be so small that vapor pressures are not sufficiently relieved to avoid an explosion. For this reason, a circular deposit preferably is at least 5 mm in diameter, more preferably at least 1.0 cm in diameter. Larger packages may have several vent-producing deposits to insure against explosion.

For convenience to the user, the deposit may be placed at a position to enhance the opening of the package to remove its contents. When the package comprises an oriented thermoplastic film, such positioning may take advantage of the tear characteristics of the film.

The novel vapor-tight package maY comprise a thermoplastic film sealed across the rim of a tray or the mouth of a jar with the deposit adhered to the film. If the thermoplastic film envelops a tray, the deposit preferably is applied to the film at a position within the rim of the tray.

Self-venting packages of the invention can be put to uses other than in a microwave oven. A package which is intended for processing in boiling water may employ a deposit which does not vent at 100° C.

The self-venting deposit usually, but not necessarily, is intended for application to the exterior of a rpackage. When a package comprises two plies of thermoplastic film, the deposit may be positioned between the two plies.

Figure 1:
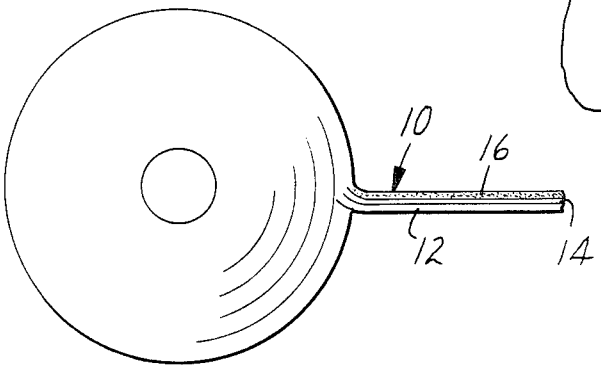
FIG. 1 is a schematic edgeview of a first tape of the invention which is useful for making a self-venting, vapor-tight package of the invention.

The tape 10 shown in FIG. 1 has a low-adhesion silicone paper carrier web 12 to which is releasably adhered a pressure-sensitive adhesive layer 14. Adhered in turn to the adhesive layer 14 is a layer 16 consisting of a dispersion of graphite particles in a polymeric binder. The tape 10 with its carrier web 12 can be wound upon itself for convenience in storage and shipment.

Figure 2:
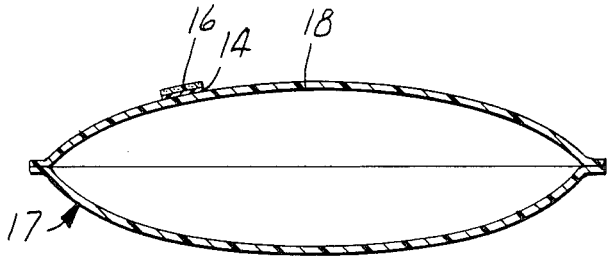
FIG. 2 is a schematic sectional view of a pouch-like package of the invention wherein a piece of the tape of FIG. 1 provides a self-venting deposit.

Upon peeling off the carrier web 12, a rectangular piece of particle-containing layer 16 of the tape is adhered by its adhesive layer 14 to a vapor-tight, pouch-like package 17 (FIG. 2) comprising thermoplastic film 18. When the package 17 is heated in a microwave oven, heat generated by microwave energy absorbed by the graphite particles of the layer 16 softens and weakens the underlying portion of the thermoplastic film 18, whereupon vapor pressure generated in the package vents the package 17 through that portion and the deposited piece of the tape.

Figure 3:
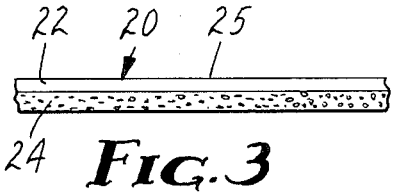
FIG. 3 is a schematic edgeview of a second tape of the invention.

The tape 20 shown in FIG. 3 consists of a low-density polyethylene carrier web 22 to which is adhered a layer 24 that is a dispersion of colloidal graphite particles in a pressure-sensitive adhesive. When the open face 25 of the carrier web 22 has a low-adhesion surface, the tape 20 can be wound upon itself for convenient storage and shipment.

Figure 4:
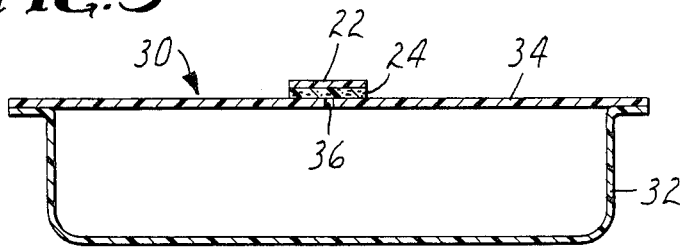
FIG. 4 is a schematic sectional view of a second package of the invention wherein a piece of the tape of FIG. 3 provides a self-venting deposit.

The package 30 shown in FIG. 4 has a molded plastic tray 32 across which is sealed a thermoplastic film 34. Adhered to the outer surface of the thermoplastic film is a deposit of a piece of the tape 20 of FIG. 3 which covers a perforation 36 in the plastic film. Heat generated by microwave energy absorbed by the graphite particles of the layer 24 softens and weakens both the adhesive of the layer 24 and the polyethylene web 22 to vent the package.

Figure 5:
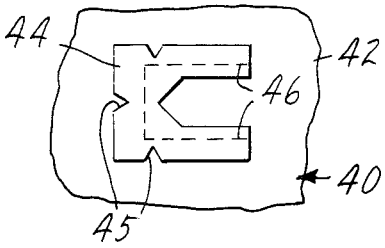
FIG. 5 is a fragmental schematic top view of a third self-venting microwave oven package of the invention.
Figure 6:
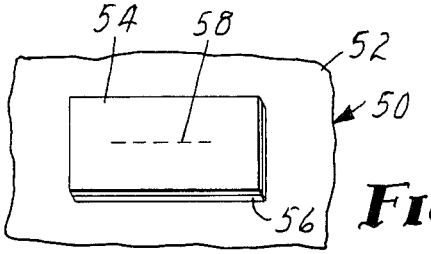
FIG. 6 fragmentally shows in perspective a fourth self-venting microwave oven package of the invention.

The fragment of a package 40 shown in FIG. 5 includes a thermoplastic film 42 to which is adhered a deposit 44 consisting of microwave-absorbing particles dispersed in an organic binder. The distinctive U-shape of the deposit 44 may be created either by printing a dispersion of the particles in a solution of the binder, or by die-cutting such a shape from the particle-containing tape 10 of FIG. 1 and adhering that shape by its adhesive layer 14 to the plastic film 42. Notches 45 in the edges of the deposit 44 may concentrate the absorbed microwave energy. When the particles are heated by microwave energy, that heat flows to and tends to soften and weaken the film 42 along the dotted line 46 which may result in a flap-like vent. When a package as shown in FIG. 5 was tested, the flap-like vent served as a pull tab for tearing the package. The fragment of a package 50 shown in FIG. 6 includes a plastic film 52 to which a piece 54 of a microwave-absorbing particle-filled layer is adhered by an adhesive layer 56 which softens and melts at a temperature lower than does the binder of the piece 54. Before doing so, a slit 58 was made in the film 52. Thus the package 50 is vented when the vapor pressure builds to a level sufficient to soften and open a channel laterally through the adhesive layer 56. The slit 58 would not be visible through the piece 54 due to the opacity provided by its microwave-absorbing particles. In the following examples, all parts are by weight except as noted.

EXAMPLE 1

The following were placed in a glass jar and mixed overnight on a laboratory shaker:

45 grams—Practical graphite powder (GX-0279, Matheson—Coleman & Bell, Norwood, OH)

45 grams—Soluble polyester of (on a molar basis) terephthalic acid (23%), isophthalic acid (21%), aliphatic diacids (7%), ethylene glycol (27%), and neopentyl glycol (21%), available as "Vitel PE 222" from B. F. Goodrich.

114.6 grams—Toluene 20.4 grams—Methyl ethyl ketone

The resulting dispersion was coated onto a 40-micrometer thick biaxially-oriented polypropylene film using a laboratory knife coater with a 250-micrometer orifice; then dried in an oven at 66° C. for 10 minutes. A layer of pressure-sensitive adhesive was laminated to the dried coating to provide a tape of the invention.

For testing purposes, a pouch of frozen corn, was purchased at a grocery store. The pouch was believed to be a laminate of polyethylene film and biaxially-oriented polyethylene terphthalate film, the latter at the exterior. A 2.54×2.54 cm piece of the tape of the invention was adhered by its adhesive layer to the pouch while the corn was frozen, and the polypropylene film was peeled off and discarded. Following instructions on the corn package except not puncturing the pouch, the corn was cooked for 7 minutes in a microwave oven. At three minutes, the pouch vented automaticallY through the tape deposit, and steam continued to escape through the vent during the final four minutes.

EXAMPLE 2

The following were placed in a glass jar and mixed overnight on a laboratory shaker:

8 grams—Carbon black ("Monarch 700" from Cabot Corp., Boston, MA).

8 grams—Soluble polyester of Example 1

54.4 grams—Toluene 9.6 grams—Methyl ethyl ketone

The resulting dispersion was coated over a release coating on a 40-micrometer thick biaxially-oriented polypropylene film using a laboratory knife coater with a 250-micrometer orifice; then dried in an oven at 66° C. for 10 minutes. A layer of pressure-sensitive adhesive was laminated to the dried coating The polypropylene film was then removed, and another layer of the same adhesive was laminated to the exposed face of the dried coating.

Used for testing purposes was a 10 by 15 cm pouch of a duplex film, the outer layer of which was biaxially-oriented poly(ethylene terephthalate) film and the inner layer of which was polyethylene. After inserting a paper towel and 12 ml of water, the pouch was sealed. A 2.54 by 2.54 cm piece of the double-coated tape was adhered by its second adhesive layer to the exterior of the pouch. When the pouch was placed in a microwave oven (high setting), within 12 seconds the pouch vented through the duplex film beneath the deposited piece of tape.

EXAMPLE 3

The following were placed in a glass jar and mixed overnight on a laboratory shaker:

50 grams—22% solution of a pressure-sensitive adhesive copolymer of isooctyl acrylate (95.5) and acrylic acid (4.5) in heptane and isopropyl alcohol.

11 grams—Practical graphite powder of Example 1

The resulting dispersion was coated onto silicone-coated release paper using a laboratory knife coater with a 300-micrometer orifice; then dried in an oven at 66° C. for 10 minutes. A 50-micrometer low-density polyethylene film was laminated to the exposed surface of the dried coating, with the pressure-sensitive adhesive copolymer of the coating serving as the laminating adhesive, thus providing a tape of the invention.

A 1.3 by 5.1 cm piece of the tape, after stripping off the release paper, was adhered by the adhesive matrix of the graphite layer to a pouch containing a paper towel and water as described in Example 2. The pouch was then placed in a microwave oven (high setting). Within one minute, heat generated in the graphite powder weakened the pouch immediately beneath the tape deposit, thus venting the pouch through the weakened spot.

EXAMPLE 4

A tape was made having at its backing a plastic film (believed to be polytetrafluoroethylene) 250 micrometers thick, throughout which was dispersed graphite powder comprising 40% by weight of the backing ("DC 7035" from Dixon Industries, Bristol, RI). To one face of the backing was laminated a layer of unfilled pressure-sensitive adhesive to provide a tape of the invention.

A 2.5 by 2.5 cm piece of the tape was adhered by its adhesive layer to a pouch containing a paper towel and water as described in Example 2. The pouch was placed in a microwave oven (high setting) for one minute. The tape weakened the bag at the spot it was applied, and the pressure built by the steam ruptured through the bag but not the tape. Instead, the steam channeled through the adhesive and the pressure was relieved.

EXAMPLE 5

A 3.8 by 1.3 cm piece of tape as described in Example 1 was placed over a 2.5 cm slit in a paper/aluminum-foil/polyethylene lid (137.5 micrometers thick) called "Wet Cadet Lid Stock" that had been sealed to the top of a 37-ml high-density polyethylene unit dose cup which was half full of water. The cup was then placed in a microwave oven (high setting) and vented through the piece of tape soon after a slight bulging of the flexible lid was observed.

The term "vapor-tight package" is intended to encompass packages which contain a pressure-release valve of the type currently being used on some coffee packages.

We claim:

1. A vapor-tight package including means for automatically venting through the package upon heating in a microwave oven, wherein the package comprises a sheet of thermoplastic film and a deposit of less extent than the film adhered to said sheet at the point where venting is desired to occur and comprising nonmetallic, microwave-absorbing particles selected from the group consisting of graphite and carbon black dispersed in a nonmetallic binder, which deposit has a thickness within the range from 10 to 300 micrometers, said particles comprising at least 10% by weight of said deposit, the dimensions of the deposit and the concentration of the particles being sufficient to provide sufficient heating of the thermoplastic film when exposed to microwave energy to cause softening of the film sufficient to cause or allow rupture and venting of the package through the softened ruptured film without arcing.

2. A package as defined in claim 1 wherein the microwave-absorbing particles are graphite.

3. A package as defined in claim 1 wherein said thermoplastic film is oriented.

4. A package as defined in claim 1 wherein the deposit has a distinctive shape.

5. A package as defined in claim 1 wherein the deposit is printed.

6. A package as defined in claim 1 comprising a tray and said thermoplastic film enclosing food within the tray.

7. A package as defined in claim 1 comprising a jar and said thermoplastic film sealed across the mouth of the jar.

8. A package as defined in claim 1 comprising a thermoplastic film forming a complete pouch.

9. A package as defined in claim 1 including a plurality of individual venting means.

10. A package as defined in claim 1 wherein the binder is an adhesive which adheres the deposit to the package.

11. A package as defined in claim 10 wherein the adhesive is a pressure-sensitive adhesive.

12. A package as defined in claim 1 wherein said deposit has a thickness from 50 to 75 micrometers.

13. A package as defined in claim 12 wherein said deposit has a minimum breadth of 5 mm.

14. A package as defined in claim 1 wherein a vapor-impervious web covers the deposit.

15. A package as defined in claim 14 wherein said deposit covers a weakness in said film.

16. A package as defined in claim 15 wherein the film is scored to provide said weakness.

17. A vapor-tight package including means for automatically venting through the package upon heating in a microwave oven, wherein the package comprises a sheet having either a weakness or an opening at the point where venting is desired to occur and a deposit of less extent than the sheet adhered by an adhesive to said sheet over said weakness or opening and comprising nonmetallic, microwave-absorbing particles selected from the group consisting of graphite and carbon black dispersed in either said adhesive or a nonmetallic binder, which deposit has a thickness within the range from 10 to 300 micrometers, said particles comprising at least 10% by weight of said deposit, the dimensions ofWI the deposit and the concentration of the particles being sufficient to provide heating of the adhesive or nonmetallic binder when exposed to microwave energy to cause softening of either the adhesive or binder and venting of the package through either the weakness or opening and either the softened adhesive or binder without arcing.

* * * * *